United States Patent [19]

Heminghous

[11] Patent Number: 4,776,901

[45] Date of Patent: Oct. 11, 1988

[54] NITROCARBURIZING AND NITRIDING PROCESS FOR HARDENING FERROUS SURFACES

[75] Inventor: William W. Heminghous, Gulfport, Miss.

[73] Assignee: Teledyne Industries, Inc., Los Angeles, Calif.

[21] Appl. No.: 32,186

[22] Filed: Mar. 30, 1987

[51] Int. Cl.[4] ..... C21B 1/74

[52] U.S. Cl. ..... 148/16.5; 148/16.6

[58] Field of Search ..... 148/16, 16.5, 16.6

[56] References Cited

U.S. PATENT DOCUMENTS

| | | | |
|---|---|---|---|
| 3,158,514 | 11/1964 | Saxton | 148/16.5 |
| 3,663,315 | 5/1972 | Hoffman et al. | 148/16.5 |
| 3,783,007 | 1/1974 | Bloom et al. | 117/95 |
| 4,016,013 | 4/1977 | Bitzer et al. | 148/16.5 |
| 4,038,109 | 7/1977 | Pflieger et al. | 148/12 F |
| 4,042,428 | 8/1977 | Asai et al. | 148/16.5 |
| 4,071,382 | 1/1978 | Riopelle | 148/16.6 |
| 4,163,680 | 8/1979 | Syrchikov et al. | 148/16.5 |
| 4,208,224 | 1/1980 | Girrell | 148/16.5 |
| 4,282,289 | 8/1981 | Kullander et al. | 428/457 |
| 4,317,587 | 3/1982 | Kaspersma et al. | 148/16.5 |
| 4,342,605 | 8/1982 | Watanabe et al. | 148/16.6 |
| 4,386,972 | 6/1983 | Knight | 148/16 |
| 4,406,714 | 9/1983 | Howes et al. | 148/16.5 |
| 4,472,209 | 9/1984 | Langerich et al. | 148/16.3 |
| 4,496,401 | 1/1985 | Dawes et al. | 148/16.5 |
| 4,531,985 | 7/1985 | Tommis | 148/16.6 |
| 4,563,223 | 1/1986 | Dawes et al. | 148/16.5 |
| 4,596,611 | 6/1986 | Dawes et al. | 148/16.5 |

FOREIGN PATENT DOCUMENTS

| | | | |
|---|---|---|---|
| 44516 | 3/1980 | Japan | 148/16.6 |
| 2170824 | 8/1986 | United Kingdom | 148/16.6 |

*Primary Examiner*—Christopher W. Brody

*Attorney, Agent, or Firm*—Gifford, Groh, VanOphem, Sheridan, Sprinkle and Dolgorukov

[57] ABSTRACT

A process for surface hardening a ferrous article such as an aircraft engine rocker lever shaft includes the steps of creating a nitrocarburized oxide layer atop the ferrous core, and subsequently creating a nitrogen enriched case between the oxide layer and the ferrous core. The article is exposed at a first elevated temperature to a mixture of an inert carrier gas, ammonia, carbon dioxide and sulfur dioxide, and thereafter exposed to the carrier gas and ammonia at a second elevated temperature higher than the first temperature. The article formed by the process has a ferrous core covered by a case of nitrogen enriched, institially hardened steel over the core, and a complex nitrocarburized oxide layer atop the case. The complex nitrocarburized oxide layer includes a lower portion comparable to a conventional epsilon nitride or white layer, and an upper porous oxide zone. The upper porous oxide zone is preferably infused with an extreme pressure oil or a liquid polytetrafluoride material. The case is generally 0.010 to 0.035 inches thick, while the complex oxide layer is about 0.0008 to 0.0015 inches thick. The surface hardened articles so formed possess substantially superior resistance to wear, galling, case crushing and surface fatigue, as compared to conventionally hardened articles.

13 Claims, No Drawings

NITROCARBURIZING AND NITRIDING PROCESS FOR HARDENING FERROUS SURFACES

BACKGROUND OF THE INVENTION

I. Field of the Invention

The present invention is directed to metalworking, and more particularly to a process for hardening ferrous surfaces.

II. Description of the Prior Art

It has long been known to harden the surfaces of ferrous articles by annealing, nitriding or nitrocarburizing (also known as carbonitriding) those surfaces. Known hardening techniques involve the controlled heating of the article, or the controlled heating of the article while simultaneously exposing the surface of the article to either a molten salt bath, or an atmosphere, containing reactive sources of nitrogen and/or oxygen. The bath or atmosphere can also contain a source of carbon, in addition to either or both of nitrogen and oxygen.

Typically, such an atmosphere comprises an inert carrier such as nitrogen gas, while the reactive source of nitrogen is ammonia gas, and the reactive source of carbon is carbon monoxide, carbon dioxide, methene, ethene, propane or other hydrocarbon. Carbon monoxide and carbon dioxide are, of course, sources of oxygen as well. Cyanide can be used as a source of both carbon and nitrogen. Sulfur (for example, as sulfur dioxide) can also be included in the atmosphere. Hydrogen gas is often employed as an actuator to facilitate the reaction of the nitrogen, carburizing and sulfiding sources with the ferrous surface. The exposing step is carried out in either a circulating or convection oven and in some cases within a fluidized bed.

While these processes have yielded hardened surfaces on ferrous articles, their use has entailed some drawbacks. Single step processes provide only a single layer of hardened material on the article. For example, the layer provided by simultaneously oxidizing and nitriding or nitrocarburizing a ferrous surface is typically referred as an epsilon nitride or a white layer, although it of course contains oxygen as well. Plural step processes, which entail changing or adding additional material sources during the process, do result in a deposition of second new layer atop an existing layer. However, these plural step processes are not useful if an existing layer is destroyed by a subsequent layer-forming step, as may often be the case. In any event, prior processes have required a relatively long time to provide the desired hardened surfaces on ferrous articles. Additionally, prior processes have not yielded hardened surfaces having an optimal combination of resistance to wear, galling, case crushing and surface fatigue.

SUMMARY OF THE PRESENT INVENTION

The present invention overcomes these and other drawbacks by providing a process yielding a ferrous article covered by a nitrogen enriched case, which is in turn covered by a complex nitrocarburized oxide layer. More particularly, the process of the present invention comprises the steps of creating a nitrocarburized oxide layer atop a ferrous core, and creating a nitrogen-enriched case between the oxide layer and the ferrous core. These steps are preferably carried out by first exposing the ferrous article to a nitrocarburizing and oxidizing atmosphere at a first elevated temperature for a period of time sufficient to create a nitrocarburized oxide layer on the article, and subsequently exposing the coated article to a nitriding atmosphere at a second, higher temperature. The nitrocarburizing and oxidizing atmosphere preferably includes ammonia and carbon dioxide, and optimally includes some sulfur dioxide, while the nitriding atmosphere includes ammonia. Preferably, the ferrous article comprises a steel in a martensitic or bainitic condition, having a temperature stable hardness of at least 30 on the Rockwell C Scale, preferably between 33 and 45 on Rockwell C Scale.

The present invention also includes the articles formed by this process. The ferrous articles of the present invention comprise a ferrous core, a case of nitrided material over the core, and a complex nitrocarburized oxide layer atop the nitrided case. Preferably, the core comprises a martensitic or bainitic steel possessing a temperature stable hardness of at least Rockwell C 30. The nitrided case is preferably a nitrogen enriched, interstitially hardened steel layer 0.010 to 0.035 inches thick. The complex nitrocarburized oxide layer atop the case preferably comprises a lower (inner) epsilon nitride layer and an upper (outer) porous oxide zone, the lower epsilon nitride layer being about one and one-half times as thick as the porous upper zone. The total complex nitrocarburized oxide layer is preferably between 0.0008 inches and 0.0015 inches thick, and can include sulfide as well. Most advantageously, the ferrous article is an aircraft engine rocker lever arm. Also advantageously, the complex layer is infused with an EP (extreme pressure) oil or a polytetraflouride material.

DETAILED DESCRIPTION OF THE PRIOR ART

The process of the invention is most useful for forming a hardened surface on an aircraft engine rocker lever shaft. The rocker lever shaft is composed of a steel which will yield a properly constituted complex zone upon nitrocarburizing and oxidizing, and which will allow modification of the complex zone by reaction and surface diffusion of sulfur compounds. The rocker lever shaft is most advantageously a steel in a martensitic or bainitic condition and possesses a hardness which is stable at the particular elevated processing temperatures employed in the process.

The process is most advantageously carried out by first positioning the rocker shaft in a furnace adapted to provide the process temperatures and flows of reactant and carrier gases required. The furnace is then purged with an inert gas, such as nitrogen gas, with at least five furnace volumes of the inert gas. During this purging, the temperature of the furnace is raised to a first elevated processing temperature. After the temperature is ramped to the first processing temperature, a mixture of reactant gases is introduced along with the inert carrier gas. The gas mixture includes sources of ammonia, carbon dioxide and sulfur dioxide, in such ratio to the amount of inert cover gas as to create a complex surface layer on the rocker lever shaft. The complex surface layer is from 0.0008 to 0.0015 inches thick, preferably about 0.0010 inches thick, and consists of a lower continuous part consisting of epsilon nitrides, overlaid with a porous zone. The complex zone includes sulfur compounds, and is only about two-thirds as thick as the epsilon nitride layer. The temperature, pressure and gas mixture in the furnace are typically maintained for one to five hours, until the complex surface layer is created.

After establishment of the complex surface layer, the process temperature is then raised to a second process temperature higher than the first process temperature. Only ammonia and the inert gas are introduced during this temperature ramping. This provides rapid subsurface diffusion of nitrogen. The higher temperature and presence of ammonia gas are typically maintained for 8 to 24 hours. This nitriding step, instead of providing a nitride layer atop the complex oxide layer, as might be expected, instead creates a case of nitrogen-enriched interstitially hardened steel between the ferrous core of the rocker lever shaft and the complex oxide layer. The nitrogen-enriched case is similar to the diffusion zone of a conventionally nitrided steel, preferably 0.012 to 0.035 inches thick.

Once the nitrogen-enriched case is formed, the rocker lever arm is cooled rapidly either in the inert gas carrier, or in a liquid quenching medium, in order to maintain the case in the preferred epsilon nitride state.

The process of the present invention is completed by a quench or soak in either an EP oil or a liquid polytetraflouride medium.

The rocker lever shaft produced by the above process possesses significantly greater improved resistance to wear, galling, case crushing and surface fatigue, in comparison to conventional hardening methods. The complex surface layer serves as a highly wear resistant and rolling or sliding fatigue resistant coating, supported by both the epsilon nitride layer and the nitrogen enriched case. Moreover, this improved hardening is obtained in cycle times which are reduced as compared to conventional gas nitriding cycle times.

The following reactions are believed to take place during the two steps of the process:

$$2\,NH_3 \xrightarrow[\text{Heat, Fe}]{} \underset{\text{(Fe)}}{2\,N} \downarrow + 3\,H_2 \quad (1)$$

$$CO_2 + H_2 \longrightarrow CO + H_2O \quad (2)$$

$$4\,CO + 3\,Fe \xrightarrow[\text{Heat}]{} \underset{\text{(Fe)}}{4\,C} \downarrow + Fe_3O_4 \quad (3)$$

$$SO_2 + H_2 \longrightarrow SO + H_2O \quad (4)$$

$$4\,SO + 3\,Fe \xrightarrow[\text{Heat}]{} \underset{\text{(Fe)}}{4\,S} \downarrow + Fe_3O_4 \quad (5)$$

During the first heating step, the ammonia not only provides a source of nitrogen for creating a nitrided layer upon the rocker lever arm core (Equation 1), but upon reaction also provides a source of hydrogen for activating the reaction of carbon dioxide and sulfur dioxide (Equations 2 and 4) with iron (Equations 3 and 5) so as to create a complex nitrocarburized oxide layer including sulfur atop the ferrous core of the rocker lever arm. The upper portion of this complex layer is a porous oxide zone, while the lower portion is, as indicated earlier, similar to a conventional epsilon nitride layer. In the second step of the process, however, only the reaction of Equation 1 is believed to have any significant effect on the article formed. The ammonia continues to provide a source of nitrogen which permeates the crystal structure of the steel rocker level shaft, most advantageously a martensitic or bainitic steel, and interstitially enriches and hardens the steel beneath the complex oxide layer. The hydrogen gas produced may serve to maintain at least the upper portion of the complex layer in a porous state.

The present invention thus provides an aircraft engine rocker lever shaft or other ferrous article possessing a superior resistance to wear, galling, case crushing and surface fatigue. The invention also provides a process for creating such a hardened ferrous article in a length of time which is reduced when compared to conventional gas nitriding times. More generally, however, the specific example above broadly exemplifies a process for hardening ferrous articles in which a nitrogen enriched case is provided between a nitrocarburized oxide layer and a ferrous core.

Having described my invention, however, many modifications thereto will become apparent to those skilled in the art to which it pertains, without deviation from the spirit of the invention, as defined by the scope of the appended claims.

I claim:

1. A process for surface hardening a ferrous article including a ferrous core, comprising the steps of first creating a nitrocarburized oxide layer atop said ferrous core, and thereafter creating a nitrogen enriched case between said oxide layer and said ferrous core.

2. The invention according to claim 1, wherein said step of creating said oxide layer is carried out by exposing said article to a nitrocarburizing and oxidizing atmosphere at an elevated temperature.

3. The invention according to claim 2, wherein said nitrocarburizing and oxidizing atmosphere includes a ammonia and carbon dioxide.

4. The invention according to claim 3, wherein said nitrocarburizing and oxidizing atmosphere includes sulfur dioxide.

5. The invention according to claim 1, wherein said step of creating said case is carried out by exposing said article to a nitriding atmosphere at an elevated temperature.

6. The invention according to claim 5, wherein said nitriding atmosphere includes ammonia.

7. A process for surface hardening a ferrous article including a ferrous core, comprising the steps of creating a nitrocarburized oxide layer atop said ferrous core, and creating a nitrogen enriched case between said oxide layer and said ferrous core; wherein said article is first exposed to a nitrocarburizing and oxidizing atmosphere including ammonia and carbon dioxide at a first elevated temperature, and is thereafter exposed to a nitriding atmosphere including ammonia at a second elevated temperature.

8. The invention according to claim 7, wherein said second elevated temperature is higher than said first elevated temperature.

9. The invention according to claim 7, wherein said nitrocarburizing and oxidizing atmosphere includes sulfur dioxide.

10. The invention according to claim 1, wherein said process is carred out on an article comprising steel in a martensitic or bainitic condition.

11. The invention according to claim 1, wherein said process comprises the further step of infusing said oxide layer with EP oil or a liquid polytetraflouride material.

12. The invention according to claim 7, wherein said process is carried out on an article comprising steel in a martensitic or bainitic condition.

13. The invention according to claim 7, wherein said process comprises the further step of infusing said oxide layer with EP oil or a liquid polytetraflouride material.

* * * * *